US008628382B2

(12) United States Patent
Bergmann

(10) Patent No.: US 8,628,382 B2
(45) Date of Patent: Jan. 14, 2014

(54) WORKPIECE HOLDER FOR A SURFACE GRINDING MACHINE

(75) Inventor: Torsten Bergmann, Schutterwald (DE)

(73) Assignee: Supfina Grieshaber GmbH & Co. KG, Wolfach (DE)

( * ) Notice: Subject to any disclaimer, the term of this patent is extended or adjusted under 35 U.S.C. 154(b) by 243 days.

(21) Appl. No.: 12/795,358

(22) Filed: Jun. 7, 2010

(65) Prior Publication Data

US 2010/0317266 A1 Dec. 16, 2010

Related U.S. Application Data

(60) Provisional application No. 61/185,850, filed on Jun. 10, 2009.

(51) Int. Cl.
*B24B 41/06* (2012.01)

(52) U.S. Cl.
USPC ..... 451/398; 451/401; 269/57; 269/95

(58) Field of Classification Search
USPC ..... 451/398, 401, 402; 269/57, 95
See application file for complete search history.

(56) References Cited

U.S. PATENT DOCUMENTS

| | | | | |
|---|---|---|---|---|
| 2,448,309 | A * | 8/1948 | Grieco | 451/369 |
| 3,226,744 | A * | 1/1966 | Marechal et al. | 470/50 |
| 4,069,530 | A | 1/1978 | Moeltzner | |
| 4,388,989 | A | 6/1983 | Edmunds et al. | |
| 5,322,079 | A * | 6/1994 | Fukutomi et al. | 134/153 |
| 5,454,215 | A * | 10/1995 | Martelli | 53/564 |
| 5,473,868 | A * | 12/1995 | Antonio | 53/566 |
| 6,645,049 | B2 * | 11/2003 | Nguyen | 451/29 |
| 6,773,335 | B2 * | 8/2004 | Hakomori | 451/44 |
| 7,104,390 | B2 * | 9/2006 | Hiramoto et al. | 198/480.1 |
| 7,418,809 | B2 * | 9/2008 | Martelli | 53/564 |
| 7,891,067 | B2 * | 2/2011 | Muhlenbruck | 29/235 |

FOREIGN PATENT DOCUMENTS

| | | |
|---|---|---|
| DE | 425457 | 2/1926 |
| DE | 2927071 | 2/1980 |
| DE | 2900009 | 7/1980 |
| DE | 10345335 | 4/2005 |
| DE | 102006044687 | 3/2008 |

* cited by examiner

*Primary Examiner* — Joseph J Hail
*Assistant Examiner* — Henry Hong
(74) *Attorney, Agent, or Firm* — Henry M Feiereisen LLC

(57) ABSTRACT

A workpiece holder for a surface grinding machine is provided. The workpiece holder includes a central workpiece holder shaft around which the workpiece holder can be driven in rotation, at least one workpiece fixture to hold at least one workpiece, and at least two holder parts movable relative to one another that jointly define the at least one workpiece fixture and that can be fixed relative to one another by means of a joining device.

26 Claims, 3 Drawing Sheets

WORKPIECE HOLDER FOR A SURFACE GRINDING MACHINE

CROSS-REFERENCE TO RELATED APPLICATIONS

Figure 1:
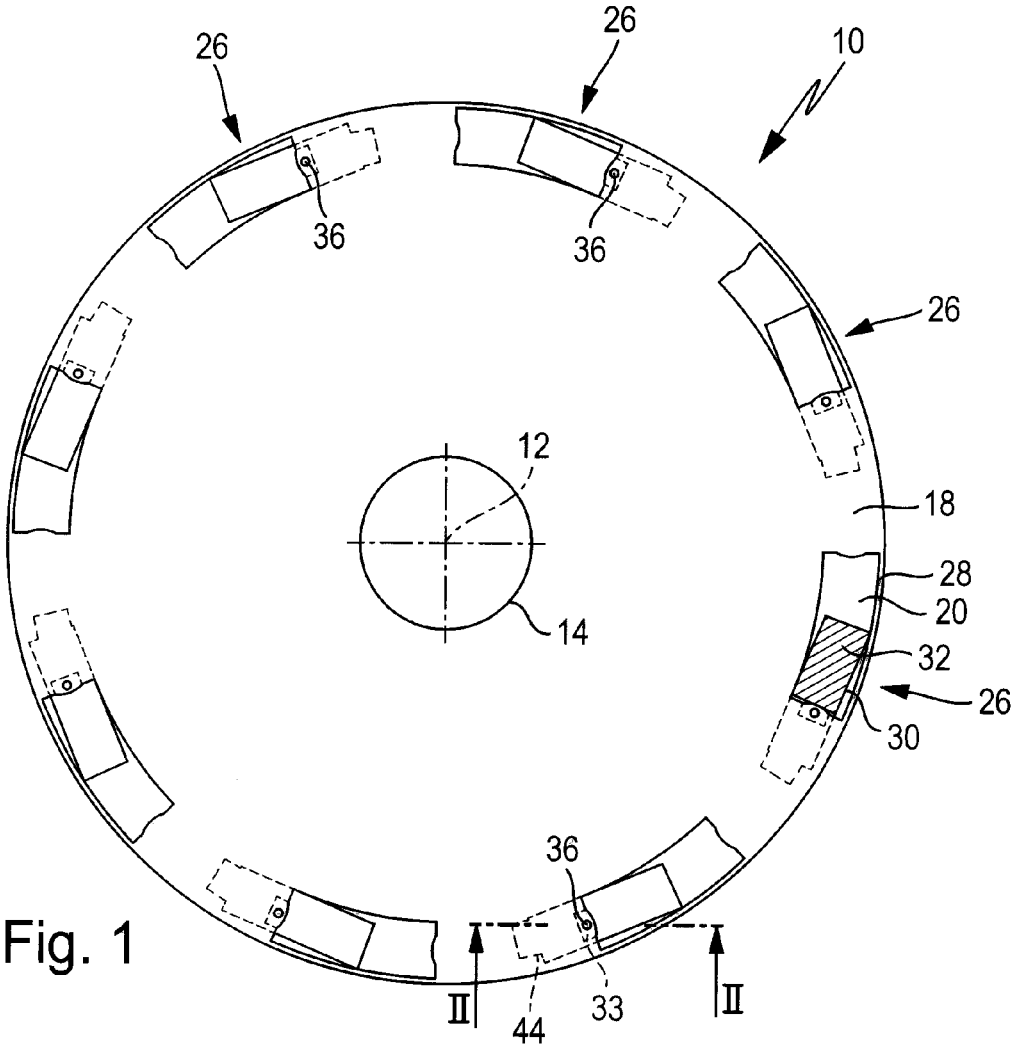

This application claims the benefit of provisional application Ser. No. 61/185,850, filed on June 2009, the contents of which are incorporated herein by reference in their entirety.

FIELD

The present disclosure relates to a workpiece holder for a surface grinding machine, especially a surface grinding machine workpiece holder.

BACKGROUND

The statements in this section merely provide background information related to the present disclosure and may not constitute prior art.

The aim of workpiece holders for surface grinding machines is to hold a workpiece and transfer it from an insertion area of a surface grinding machine into a machining area of a surface grinding machine. In the machining area of a surface grinding machine, at least one grinding tool is in surface-grinding engagement with a surface of the workpiece held on or in the workpiece fixture of the workpiece holder.

Since the workpiece is moved into a grinding gap that may be comparatively small, for example smaller than about 3 cm, there are stringent requirements for the stability of the relatively flat workpiece holder. For this reason, workpiece holders of the kind mentioned above are ordinarily made of a comparatively hard material in order to reach relatively high deformation resistance even when relatively thin materials are used for the workpiece holder. For highly precise surface grinding of a workpiece, however, it is necessary to retain the at least one workpiece with as little play as possible on the workpiece fixture. This leads to the fact that the workpiece fixture also has to be made with low tolerances and the manufacture of known workpiece holders is correspondingly demanding and costly.

Because of the above relationships, there are high requirements also for still unmachined workpieces, so that they can interact with a workpiece fixture for a workpiece with as little play as possible.

SUMMARY

According to the present disclosure, a workpiece holder is provided with at least two holder parts movable relative to one another that jointly define at least one workpiece fixture, and that can be fixed relative to one another by means of a joining device.

The workpiece holder according to the present disclosure allows a variable delimitation of at least one workpiece fixture, so that the workpiece fixture can be matched to the shape of a workpiece. This allows compensating of tolerances of unmachined workpieces. It is, however, also particularly advantageous that the variable delimitation of a workpiece fixture makes it possible to hold workpieces of different sizes, so that the workpiece holder according to the present disclosure is suitable for workpieces of various sizes. The result of this is that specific workpiece holders no longer have to be made available for workpieces of different sizes, as has been known from the prior art. Instead, in order to use at least one of its workpiece fixtures, the workpiece holder according to the present disclosure can be used to fasten workpieces of different sizes on or in this workpiece fixture. The procurement costs are reduced, and the expense for storing workpiece holders can thereby be reduced.

The workpiece holder according to the present disclosure can also be used for a first size of workpiece, and then be left in a mounted position on a surface grinding machine with the possibility of matching it to a second workpiece size. The downtimes during the operation of a surface grinding machine can thereby be reduced.

In one form, the workpiece holder comprises at least two holder parts movable relative to one another, each of which constitutes at least one part of the frame of at least one workpiece fixture. The shape and/or size of the workpiece fixture is changed by moving the holder parts. When the shape and size of the workpiece fixture is optimally set for a workpiece to be machined by moving the holder parts relative to one another, the holder parts can be fixed relative to one another in this condition by means of a joining device.

It is especially advantageous if the holder parts can rotate relative to one another, which makes it especially easy to adapt the size and shape of a workpiece fixture.

Advantageously, each of the holder parts can be rotated around the central workpiece holder axis, so that the holder parts can be arranged concentric to one another and in particular be moved relative to one another in holder planes parallel to one another.

Advantageously, each of the holder parts delimits a plurality of workpiece fixtures, so that a plurality of workpieces can be held on the workpiece holder. The different workpiece fixtures can be matched to a given workpiece size with regard to their shape and their size by moving the holder parts simultaneously.

According to one form of the present disclosure, at least two of the plurality of workpiece fixtures are spaced identically in the radial direction from the workpiece axis. This makes it possible to guide workpieces held on the workpiece fixtures along the same path of motion through a machining area of a surface grinding machine.

When the workpiece fixtures are spaced identically relative to one another in the circumferential direction, the workpiece holder can be driven uniformly in the direction of rotation for uniform machining of all of the workpieces held on the workpiece holder, for example continuously or stepwise.

According to one form of the present disclosure, at least one of the holder parts has a circumferentially closed workpiece fixture frame. This increases the mechanical stability of this holder part.

According to another form of the present disclosure, at least one of the holder parts has a circumferentially open workpiece fixture frame, which allows an especially easy adaptation of the size and shape of the workpiece fixture for workpieces with round geometries.

If the circumferentially open workpiece fixture frame points radially outward, this workpiece fixture frame can be used to press the workpiece radially outward against a workpiece fixture frame of another holder part pointing radially inward. This allows it to hold a workpiece on the workpiece holder with special reliability, at a desired radial distance from the workpiece holder axis.

It is preferred for the holder parts to extend in planes of motion parallel to one another, so that each of the holder parts can be designed as disk bodies that are relatively easy to manufacture. In particular, it is advantageous for the holder parts to rest on one another, so that mutual parallel guidance of the holder parts becomes possible.

Another form of the present disclosure provides that at least one of the holder parts has at least one workpiece fixture frame element that penetrates into a plane of motion of another holder part. This allows an enlargement of the active surface of a workpiece fixture frame, by which a reduction of locally occurring contact forces between a workpiece fixture frame and a workpiece held on the workpiece holder is achieved. The at least one workpiece fixture frame element also acts as wear protection.

The at least one workpiece fixture frame element, for example, can be designed integral with the holder part, or it can be provided for separately. Such a separate workpiece fixture frame element in particular is detachably connected to the holder part, especially using a screw connection, so that the at least one workpiece fixture element can be removed and replaced by a workpiece fixture frame element of identical size and/or shape or with a different size and/or shape.

It is also advantageous for the holder parts to be mounted against one another so that possible relative positions between the holder parts are preset.

It is also preferred for the joining device to be arranged so that is collinear with the workpiece holder axis. In this way, the holder parts can be fixed relative to one another in the area of the central workpiece holder axis. Reliable fixation is thus possible, especially with thin, disk-shaped holder parts.

It is also preferred for the joining device to consist of a fastening device for fastening the workpiece holder to a rotary drive device of a surface grinding machine. A separately provided joining device can hereby be dispensed with and a fastening device already present on a surface grinding machine can be used to fasten a workpiece holder.

The present disclosure also relates to a surface grinding machine, particularly a double surface grinding machine with a workpiece holder described above.

Further areas of applicability will become apparent from the description provided herein. It should be understood that the description and specific examples are intended for purposes of illustration only and are not intended to limit the scope of the present disclosure.

DRAWINGS

Figure 2:
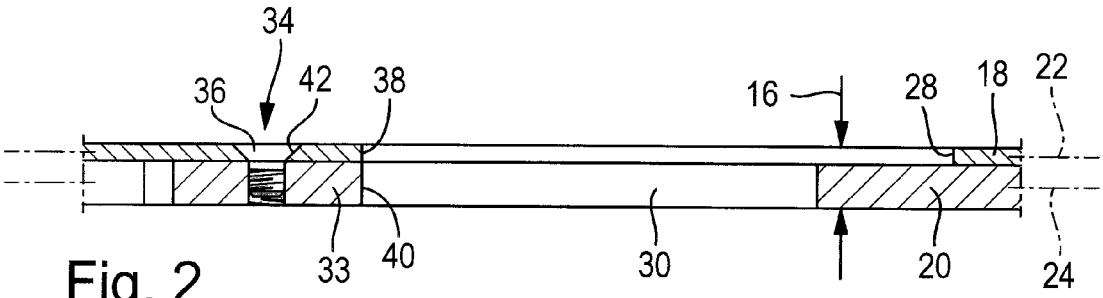
Figure 3:
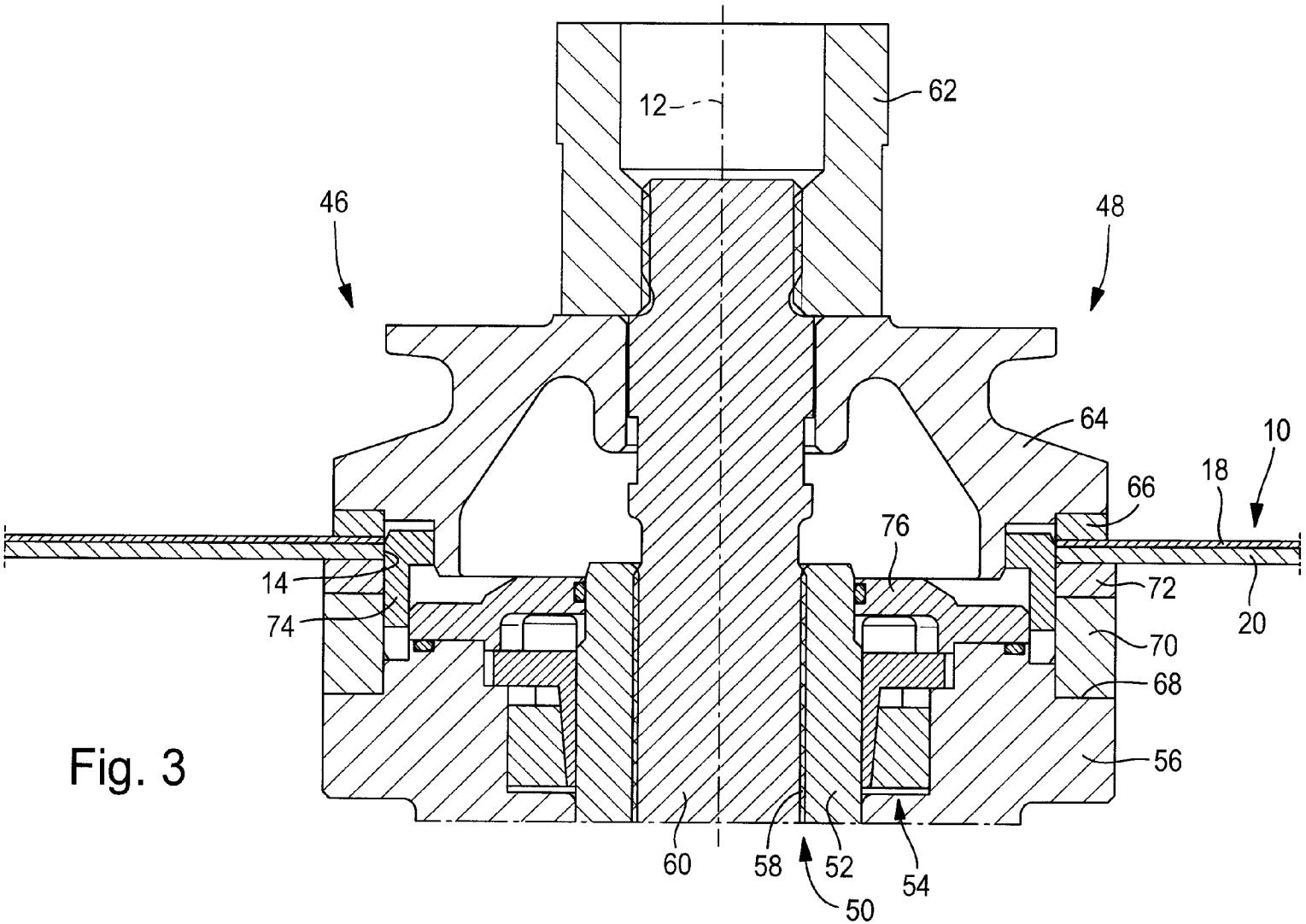
Figure 4:
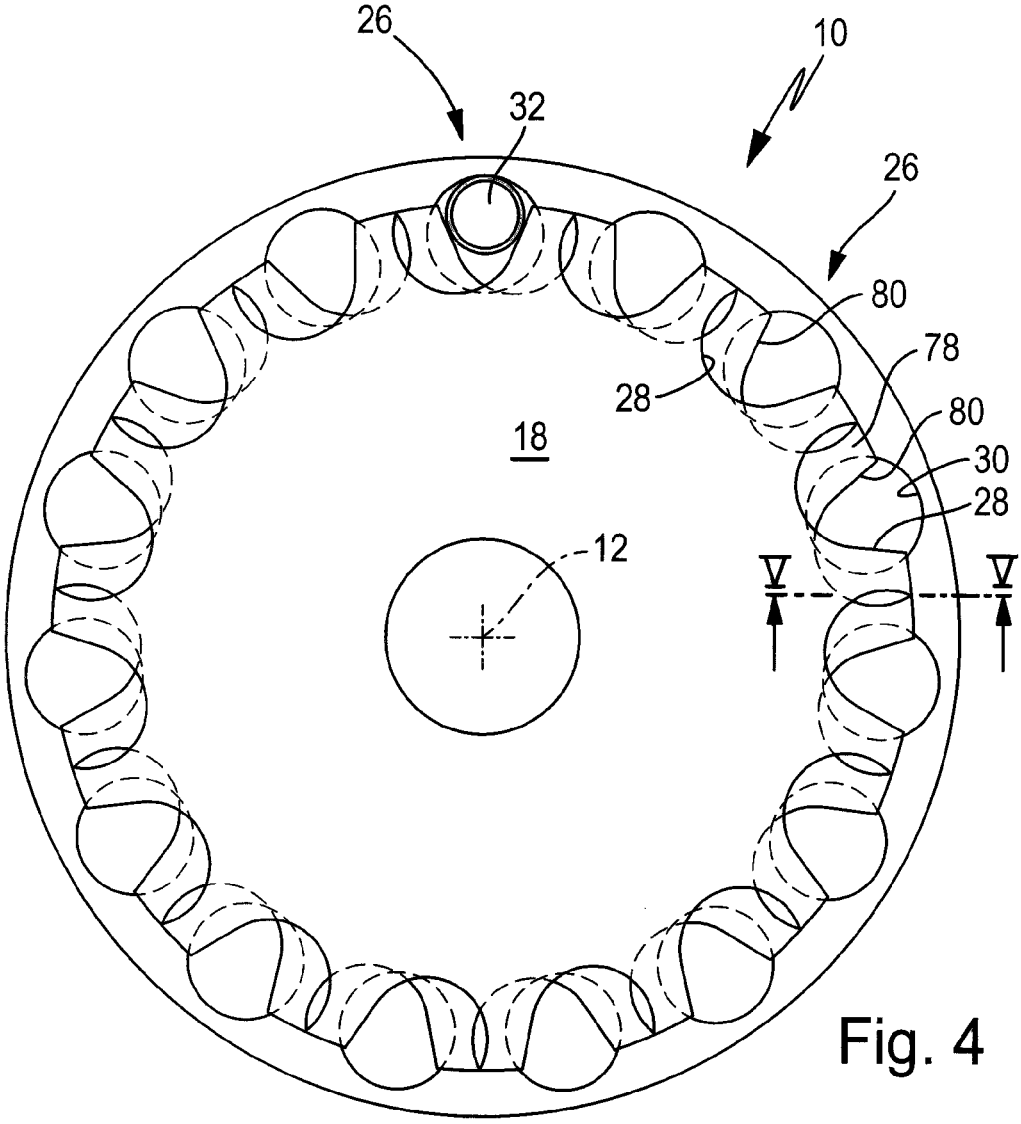
Figure 5:
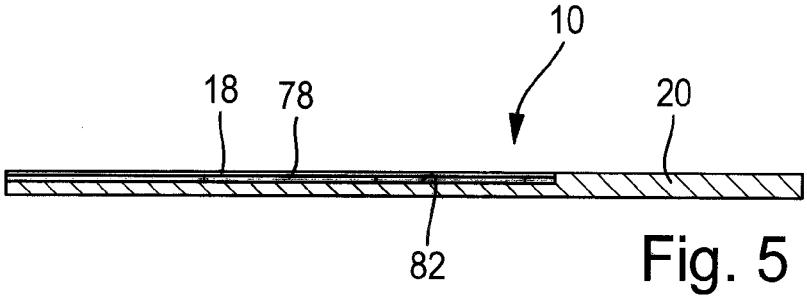

In order that the disclosure may be well understood, there will now be described various forms thereof, given by way of example, reference being made to the accompanying drawings, in which:

FIG. 1: a top view of one form of a workpiece holder for a surface grinding machine;

FIG. 2: a side view of the workpiece holder according to FIG. 1 along a cutting plane labeled II-II in FIG. 1;

FIG. 3: a cross-sectional side view of a joining device by means of which holder parts of the workpiece holder of Figure I can be fixed relative to one another;

FIG. 4: a top view of another form of a workpiece holder for a surface grinding machine; and FIG. 5: a side view of the workpiece holder according to FIG. 4 along a cutting plane labeled V-V in FIG. 4.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

FIG. 1 shows one form of a workpiece holder designated overall with the reference numeral 10. The workpiece holder 10 has a centered workpiece holder axis 12 around which the workpiece holder 10 can be driven in rotation. The workpiece holder 10 has a fastening section 14 for fastening the workpiece holder to a rotary drive device of a surface grinding machine. The fastening section 14 in particular is designed in the form of an opening concentric to the workpiece holder axis 12.

The workpiece holder 10 has a disk shape, particularly a circular disk shape. The diameter of the workpiece holder, for example, is approximately at least 50 cm. Compared to this, the thickness of the workpiece holder 10 designated with 16 in FIG. 2 is small, and is about 2 cm at the most, for example.

The workpiece holder 10 has two disk-shaped holder parts, namely a first holder part 18 and a second holder part 20. The holder part 18 is in the position of use of the workpiece holder 10, for example it is located at the top and the second holder part 20 is at the bottom.

The holder parts 18 and 20 extend in planes of motion 22 and 24 parallel to one another. The holder parts 18 and 20 can rotate in their associated planes of motion 22 and 24 around the workpiece holder axis 12.

As shown in FIG. 2, when the bottom holder part 20 is thicker than the top holder part 18, the bottom holder part 20 has greater deformation resistance and thus constitutes a flat support for a thinner top part 18.

The workpiece holder 10 has a plurality of workpiece fixtures 26 that have the same radial distance relative to the workpiece holder axis 12. The workpiece fixtures 26 are also spaced identically from one another in the circumferential direction.

Each of the holder parts 18 and 20 has workpiece fixture frames that are formed by openings in the holder parts 18 and 20. The first holder part 18 has circumferentially closed workpiece fixture frames 28 in the form of ring segments, as shown in the drawing, for example. The second holder part 20 likewise has a plurality of workpiece fixture frames 30 that are also preferably designed in essentially the form of ring segments.

The workpiece fixture frames 28 and 30 overlap one another, so that an opening is formed in an overlap area seen in the top view of the workpiece holder 10, in which a workpiece 32 indicated in broken lines in FIG. 1 can be held. The workpiece 32 extends in a direction parallel to the workpiece holder axis 12, at least beyond one of the holder parts 18 and 20.

Because of the rotational capability of the holder parts 18 and 20 relative to one another, the size of the workpiece fixtures 26 formed along with the workpiece fixture frames 28 and 30 is continuously adjustable.

The first holder part 18 also has a workpiece fixture frame element 33 that penetrates into the plane of motion 24 of the second holder part 20, and extends into a space framed by the workpiece fixture frame 30. The workpiece fixture frame element 33 is detachably connected to the first holder part 18 by a connector 34 in the form of a screw connection 36.

The workpiece fixture frame element 33 serves to lengthen a frame section 38 of the workpiece fixture frame 28 of the first holder part 18 in a direction parallel to the workpiece holder axis 12. For this purpose, the workpiece fixture frame element 33 has a frame surface 40.

In the illustrated exemplary form, the position of the workpiece fixture frame element 33 is predetermined by a bore 42 in the first holder part 18. In an alternative form of the present disclosure not shown in the drawing, the position of the workpiece fixture frame element 33 is adjustable relative to the first holder part 18, for example by using elongated holes.

The workpiece fixture frame element 30 of the second holder part 20 has a receiving section 44, which is adapted to the shape of the workpiece fixture frame element 33.

The workpiece fixture frame element 33 can be received in the receiving section 44 when the holder parts 18 and 20 are set relative to one another such that the size of the workpiece fixture 26 is maximized.

The holder parts 28 and 20 can be fixed relative to one another using a joining device 46 shown in FIG. 3. The fastening device 46 is preferably designed in the form of a fastening device 48 by means of which the workpiece holder 10 is connected rotationally fixed to a rotary drive device 50 of a surface grinding machine.

The rotary drive device 50 comprises a drive shaft 52 that is connected rotationally fixed to a housing part 56 through a clamping device 54. The drive shaft 52 is connected through a threaded section 58 to a bolt 60 that passes through the fastening section 14 of the workpiece holder 10. The bolt 60 is connected at its end facing away from the rotary drive device 50 to a hydraulic tension nut 62. The tension nut 62 acts through a tension lock 64 and through a spacer ring 66 on the top face of the holder part 18.

The housing part 56 has a shoulder 68 on which a spacer ring 70 is mounted. Another spacer ring 72 is mounted on the spacer ring 70.

The workpiece holder 10 with its holder parts 18 and 20 is clamped in between the spacing elements 66 and 72 located on opposite sides of the workpiece holder. On the one hand, a rotational motion of the drive shaft 52 can be transmitted in this way to the workpiece holder 10. On the other hand, the holder parts 18 and 20 can be fixed relative to one another in this way.

For the rotating shaft of the drive device 50 to be aligned with the workpiece holder axis 12, a centering ring 74 is provided that is mounted on the tension lock 64 and is joined to the fastening section 14 of the workpiece holder 10.

To protect the clamping device 54, a ring seal element 76 is also provided.

Another form of a workpiece holder 10 is illustrated in FIGS. 4 and 5. The workpiece holder 10 according to FIGS. 4 and 5, in contrast to the workpiece holder 10 described above, has a third holder part 78 that is likewise designed in disk shape. The third holder part 78, for example, is located between the first holder part 18 and the second holder part 20.

The holder parts 18, 20, and 78 can be rotated relative to one another around a central workpiece holder axis 12. The holder parts 18 and 78 are mounted on the holder part 20. For this purpose, the holder part 20 has a pocket-shaped circular recess 82 in which holder parts 18 and 78 are accommodated.

The second holder part 20 has circumferentially closed workpiece fixture frames 30. The second holder part 18 has circumferentially open workpiece fixture frames 28 pointing radially outward that extend as grooves toward the workpiece holder axis 12 when viewed from the top of the workpiece holder 10.

The third holder part 78 likewise has a circumferentially open workpiece fixture frame 80 pointing radially outward.

The workpiece fixture space frames 28, 30, and 80 extend in planes offset from one another relative to the workpiece holder axis 12. The mentioned workpiece fixture space frames in each case jointly form a workpiece fixture 26. A workpiece 32 with a round outer geometry can be reliably fastened with special accuracy in each workpiece fixture. Different workpiece sections of the workpiece 32 rest against all of the workpiece fixture frames 28, 30, and 80. With the assistance of the workpiece fixture frames 28 and 80 the workpiece 32 is pressed radially outward against a section of the workpiece fixture frame 30 pointing radially inward.

Reference is made to the above description of the workpiece holder 10 according to FIGS. 1 and 3 in other respects with reference to the workpiece holder 10 described in FIGS. 4 and 5.

The workpiece holder 10 according to FIGS. 1 to 3 is especially well suited for polygonally defined workpieces 32, for example rectangular or square parts. The workpiece holder 10 illustrated in FIGS. 4 and 5 is especially well suited for holding round parts.

It is possible for a workpiece holder 10 to have not only two or three holder parts, but four or even more holder parts.

It should be noted that the disclosure is not limited to the various forms described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A workpiece holder for a surface grinding machine, comprising:

at least two disk-shaped holder parts having closed openings formed therein and movable relative to one another about a workpiece holder axis to adjustably position the openings in overlapping relationship, thereby jointly defining at least one workpiece fixture which is adjustable in size to allow holding of a selected one of a plurality of workpieces of different dimensions on opposite end faces;

a workpiece fixture frame element detachably connected to one of the holding parts and positioned in direct contact with the workpiece, said workpiece fixture frame element being sized to project into a plane of motion of the other one of the holder parts to thereby extend the workpiece fixture in a direction parallel to the workpiece holder axis; and a joining device configured to fix the two holder parts relative to one another.

2. The workpiece holder of claim 1, wherein the holder parts are rotatable relative to one another.

3. The workpiece holder of claim 1, wherein each of the holder parts is rotatable around the workpiece holder axis.

4. The workpiece holder of claim 1, wherein the holder parts define a plurality of said workpiece fixture.

5. The workpiece holder of claim 4, wherein at least two of the plurality of workpiece fixtures are spaced identically in a radial direction from the workpiece holder axis.

6. The workpiece holder of claim 4, wherein the workpiece fixtures are spaced identically relative to one another in a circumferential direction.

7. The workpiece holder of claim 1, wherein at least one of the holder parts has a circumferentially closed workpiece fixture frame.

8. The workpiece holder of claim 1, wherein at least one of the holder parts has a circumferentially open workpiece fixture frame.

9. The workpiece holder of claim 8, wherein the circumferentially open workpiece fixture frame points radially outward.

10. The workpiece holder of claim 1, wherein the holder parts extend in planes of motion parallel to one another.

11. The workpiece holder of claim 1, wherein the holder parts are mounted on one another.

12. The workpiece holder of claim 1, wherein the joining device is configured to extend in collinear relationship to the workpiece holder axis.

13. The workpiece holder of claim 1, wherein the joining device is formed by a fastening device for fastening the workpiece holder to a rotary drive device of the surface grinding machine.

14. A surface grinding machine, comprising a workpiece holder including at least two disk-shaped holder parts having closed openings formed therein and movable relative to one another about a workpiece holder axis to adjustably position the openings in overlapping relationship, thereby jointly defining at least one workpiece fixture which is adjustable in size to allow holding of a selected one of a plurality of workpieces of different dimensions on opposite end faces, a workpiece fixture frame element detachably connected to one of the holding parts and positioned in direct contact with the workpiece, said workpiece fixture frame element being sized to project into a plane of motion of the other one of the holder parts to thereby extend the workpiece fixture in a direction parallel to the workpiece holder axis, and a joining device configured to fix the two holder parts relative to one another.

15. The surface grinding machine of claim 14, wherein the holder parts are rotatable relative to one another.

16. The surface grinding machine of claim 14, wherein each of the holder parts is rotatable around the workpiece holder axis.

17. The surface grinding machine of claim 14, wherein the holder parts define a plurality of said workpiece fixture.

18. The surface grinding machine of claim 17, wherein at least two of the plurality of workpiece fixtures are spaced identically in a radial direction from the workpiece holder axis.

19. The surface grinding machine of claim 17, wherein the workpiece fixtures are spaced identically relative to one another in a circumferential direction.

20. The surface grinding machine of claim 14, wherein at least one of the holder parts has a circumferentially closed workpiece fixture frame.

21. The surface grinding machine of claim 14, wherein at least one of the holder parts has a circumferentially open workpiece fixture frame.

22. The surface grinding machine of claim 21, wherein the circumferentially open workpiece fixture frame points radially outward.

23. The surface grinding machine of claim 14, wherein the holder parts extend in planes of motion parallel to one another.

24. The surface grinding machine of claim 14, wherein the holder parts are mounted on one another.

25. The surface grinding machine of claim 14, wherein the joining device is configured to extend in collinear relationship to the workpiece holder axis.

26. The surface grinding machine of claim 14, wherein the joining device is formed by a fastening device for fastening the workpiece holder to a rotary drive device of the surface grinding machine.

* * * * *